US011241127B1

(12) United States Patent
Briggs

(10) Patent No.: US 11,241,127 B1
(45) Date of Patent: Feb. 8, 2022

(54) AUTOMATIC TOILET SEAT COVER DISPENSING AND REMOVING APPARATUS

(71) Applicant: Richard G. Briggs, Simi, CA (US)

(72) Inventor: Richard G. Briggs, Simi, CA (US)

( * ) Notice: Subject to any disclaimer, the term of this patent is extended or adjusted under 35 U.S.C. 154(b) by 0 days.

(21) Appl. No.: 17/019,350

(22) Filed: Sep. 13, 2020

(51) Int. Cl.
*A47K 13/22* (2006.01)
*A47K 13/16* (2006.01)

(52) U.S. Cl.
CPC ..... *A47K 13/22* (2013.01); *A47K 13/16* (2013.01)

(58) Field of Classification Search
CPC ..... A47K 13/22
USPC ..... 4/243.1, 244.1, 245.1
See application file for complete search history.

(56) References Cited

U.S. PATENT DOCUMENTS 1,108,799 A * 8/1914 Shortt ..... A47K 13/22 4/244.2
1,589,429 A * 6/1926 Rouse ..... A47K 13/20 4/243.3
1,608,988 A * 11/1926 Maroni ..... A47K 13/22 4/244.2
1,858,794 A * 5/1932 Vallecchi ..... A47K 13/225 4/243.3
1,912,363 A * 6/1933 De Waide ..... A47K 17/003 225/106
2,123,012 A * 7/1938 Kreutzig ..... A47K 13/22 4/244.2
2,243,134 A * 5/1941 Stiller ..... A47K 13/225 4/243.3
3,751,738 A * 8/1973 Vairo ..... A47K 13/22 4/243.3
4,213,212 A * 7/1980 Hefty ..... A47K 13/145 4/243.2
4,297,750 A * 11/1981 Lutz ..... A47K 13/22 4/244.2
4,745,640 A * 5/1988 Nelson ..... A47K 13/14 4/245.6
4,908,262 A * 3/1990 Nelson ..... A47K 13/14 4/245.6
4,935,967 A * 6/1990 Cour ..... A47K 13/145 4/237
4,944,046 A * 7/1990 Huh ..... A47K 13/16 4/244.1
5,561,867 A * 10/1996 Roginsky ..... A47K 13/225 4/243.3
6,038,708 A * 3/2000 Schreck ..... A47K 13/10 4/244.1
6,615,411 B2 * 9/2003 Johnson ..... A47K 13/225 4/243.3
9,015,905 B1 * 4/2015 Chen ..... E05B 1/0069 16/430
9,095,242 B2 * 8/2015 Wang ..... A47K 13/145
10,993,592 B2 * 5/2021 Shimon ..... A47K 13/14
(Continued)

*Primary Examiner* — Lori L Baker
(74) *Attorney, Agent, or Firm* — Savantek Patent Services; Ivan E. Rozek

(57) ABSTRACT

An automatic rolled sheet that can unroll to become toilet seat cover. The dispensing roll is housed within a dispenser housing. The dispenser housing is vertically oriented and located behind the toilet seat. The dispensed sheet is pulled from the dispenser housing onto a toilet seat via a motorized take-up spool within a take-up housing located under the toilet bowl. A sensor detects the presence of a person, and when the person leaves the vicinity of the toilet, the motorized take-up spool winds the used toilet cover sheet onto the take-up spool.

2 Claims, 11 Drawing Sheets

(56) References Cited

U.S. PATENT DOCUMENTS

| | | | | |
|---|---|---|---|---|
| 2002/0088049 | A1* | 7/2002 | Johnson | A47K 13/225 4/243.3 |
| 2009/0106885 | A1* | 4/2009 | Sagre | A47K 13/10 4/246.1 |
| 2009/0293183 | A1* | 12/2009 | Wei | A47K 13/225 4/243.3 |
| 2020/0329927 | A1* | 10/2020 | Han | A47K 13/20 |
| 2020/0337509 | A1* | 10/2020 | Ho | A47K 13/302 |
| 2020/0354938 | A1* | 11/2020 | Zhou | E03D 9/08 |

* cited by examiner

AUTOMATIC TOILET SEAT COVER DISPENSING AND REMOVING APPARATUS

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of toilet seat covers and more specifically to rolled toilet seat cover system including a dispenser roll and a motorized take-up roll.

Toilet seats have been known to harbor germs, STDs, fecal remains and urinary remains of the person or persons using the toilet previously. For cleanliness purposes some people prefer to use a fresh sheet of material on top of the traditional toilet seat to avoid potential germs and debris that may be found on an uncovered toilet seat.

The sheets are generally stored in a dispenser near the toilet. A person must remove the sheet, place it carefully on the toilet and then dispose of the sheet after use.

There are a number of disadvantages to this prior technology. First, the user must pull the thin sheet out of its dispenser without damaging or tearing it. Second, the user must carefully place the sheet on the toilet seat. This act can in itself cause the user's fingers and hand to come into contact with the top of an unsanitary toilet seat. Third, the user must sit down on the sheet without having it slide out of place. Fourth, the user must dispose of the sheet after use. In many cases the user elects to through the sheet into the toilet bowl creating a possible blockage when flushing the sheet plus fecal remains down the pipes of the toilet. Fifth, the entire process is time consuming. Sixth, the sheets are generally made of absorbent paper which absorb bodily fluids and therefore are not completely hygienic.

BRIEF SUMMARY OF THE INSTANT INVENTION

The primary object of the invention is to provide a rolled toilet seat cover that automatically advances a sheet of protective material onto a toilet seat after each use of the toilet.

Another object of the invention is to provide a rolled toilet seat cover that uses a plurality of vertically stacked smaller rolls to reduce the width of the toilet roll housing.

Another object of the invention is to provide a rolled toilet seat cover that includes a method to attach the end of one roll to the beginning of the next roll so that sheet material from all stacked rolls can be automatically dispensed and used.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a rolled toilet seat cover comprising: a dispenser roll housing, a take-up roll housing, a sensor, a plurality of dispensing rolls, a take-up roll assembly, a toilet bowl, a toilet bowl seat, the dispensing rolls each made of thin sheet material and having a plurality of evenly spaced apertures that are similar in size to a toilet seat aperture, each the dispensing roll including a dispensing spool, the dispenser roll housing placed vertically behind the toilet bowl, the take up roll housing placed below the toilet bowl, the beginning and end of each dispensing roll sheet having a magnetic strip fixedly attached across the width of the roll, the take-up roll assembly including a take-up spool powered by an electric motor and controlled by an electronic encoder circuit, the dispensing rolls removably housed within the upper dispenser roll housing, the take-up roll assembly housed within the take-up roll housing roll housing, the dispensing roll sheet directed down from the dispensing housing and over the toilet bowl seat and then down through a slit in the take-up roll housing and onto the take-up roll spool, and the sensor positioned to sense the presence of a person and sending a signal to the electronic encoder circuit when the person is no longer in range of the toilet to command the motor to wind the dispensing roll sheet onto the take-up spool until a new aperture in the sheet is directly over the toilet bowl seat.

BRIEF DESCRIPTION OF THE DRAWINGS

The drawings constitute a part of this specification and include exemplary embodiments to the instant invention, which may be embodied in various forms. It is to be understood that in some instances various aspects of the instant embodiments may be shown exaggerated or enlarged to facilitate an understanding of the instant embodiment.

DETAILED DESCRIPTION OF THE PREFERRED EMBODIMENTS

Detailed descriptions of the preferred embodiment are provided herein. It is to be understood, however, that the present invention may be embodied in various forms to be able to conform to the differing configurations of public toilets. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
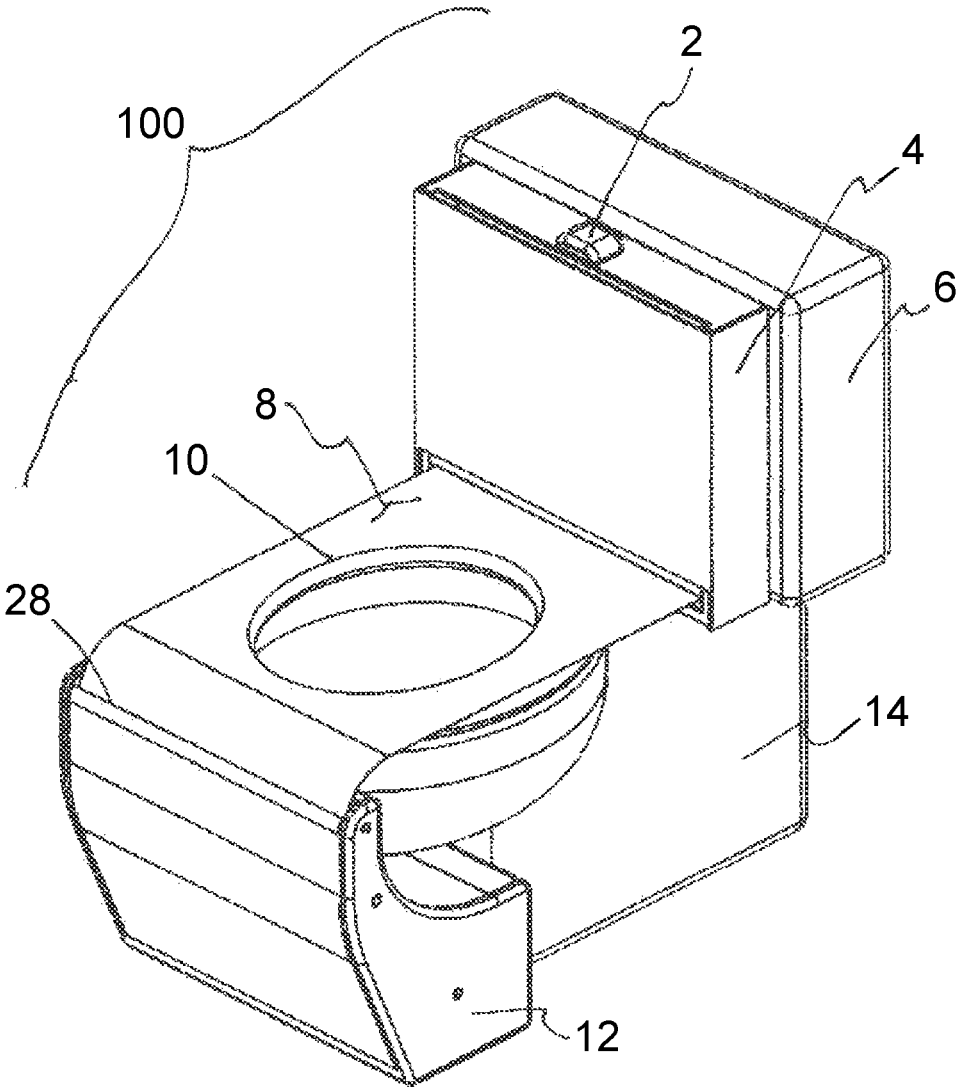
FIG. 1 is a perspective view of the embodiment.
Figure 2:
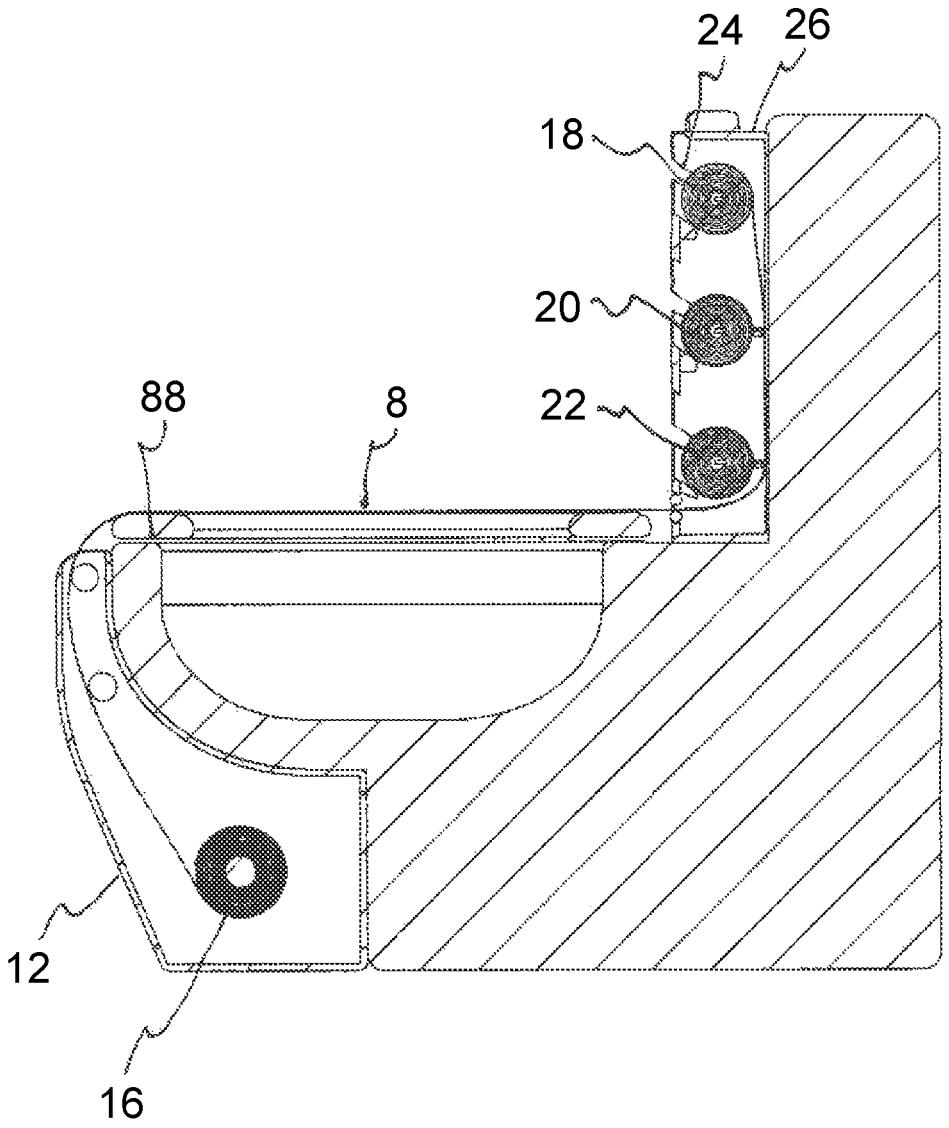
FIG. 2 is a side view of the embodiment.

Referring now to FIG. 1 we see a perspective view of the invention 100. A toilet 14, is fitted with a dispenser roll housing 4 and a take-up roll housing 12. A sheet of thin material 8 is unwound from a dispenser roll 18 within the housing 4. The sheet 8 proceeds through a slit 28 to be rolled up on a take-up roll 16 as shown in FIG. 2. An aperture 10 within the sheet 8 is approximately the size and shape of the aperture in the toilet seat 88. A sensor 2 detects the presence of a person. When the person leaves the proximity of the toilet, it sends a signal to a motor 40 and encoder 42 shown in FIG. 10 which rolls in the sheet 8 and stores it within housing 12 for later disposal.

FIG. 2 is a side section view of the invention 100. Dispensing rolls 18, 20, 22 are stacked in a vertical orientation within housing 6. Slots 24 allow spools to slide in and out of the rear portion 6 of the dispensing housing. The vertical orientation of the rolls 18, 20, 22 allows for storage of a relatively large quantity of sheeting material while taking up relatively little space between the back of the user and the front of the toilet assembly 6. Rollers 44, 46 help guide the sheet 8 onto the take-up spool 16.

Figure 3:
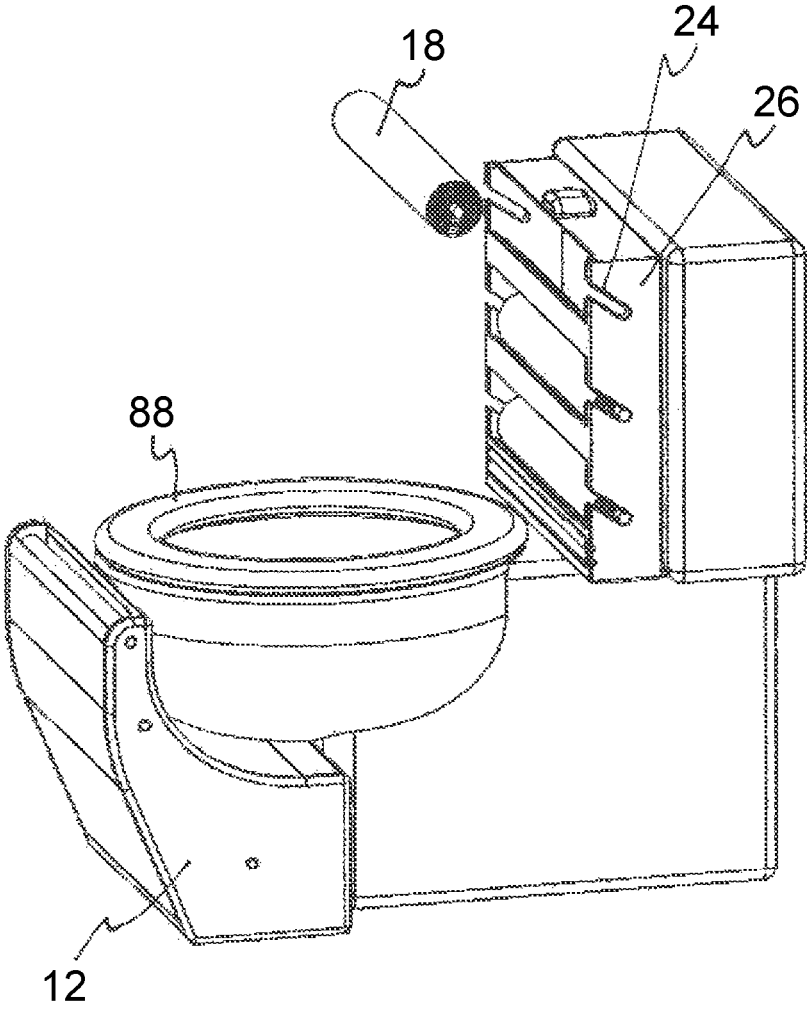
FIG. 3 is a perspective view of the embodiment with the dispensing roll housing cover removed.

FIG. 3 is a side perspective view of the invention 100 showing the housing cover 4 removed and one dispensing roll 18 removed from rear housing 26. The receiving slots 24 allow for easy removal and replacement.

Figure 4:
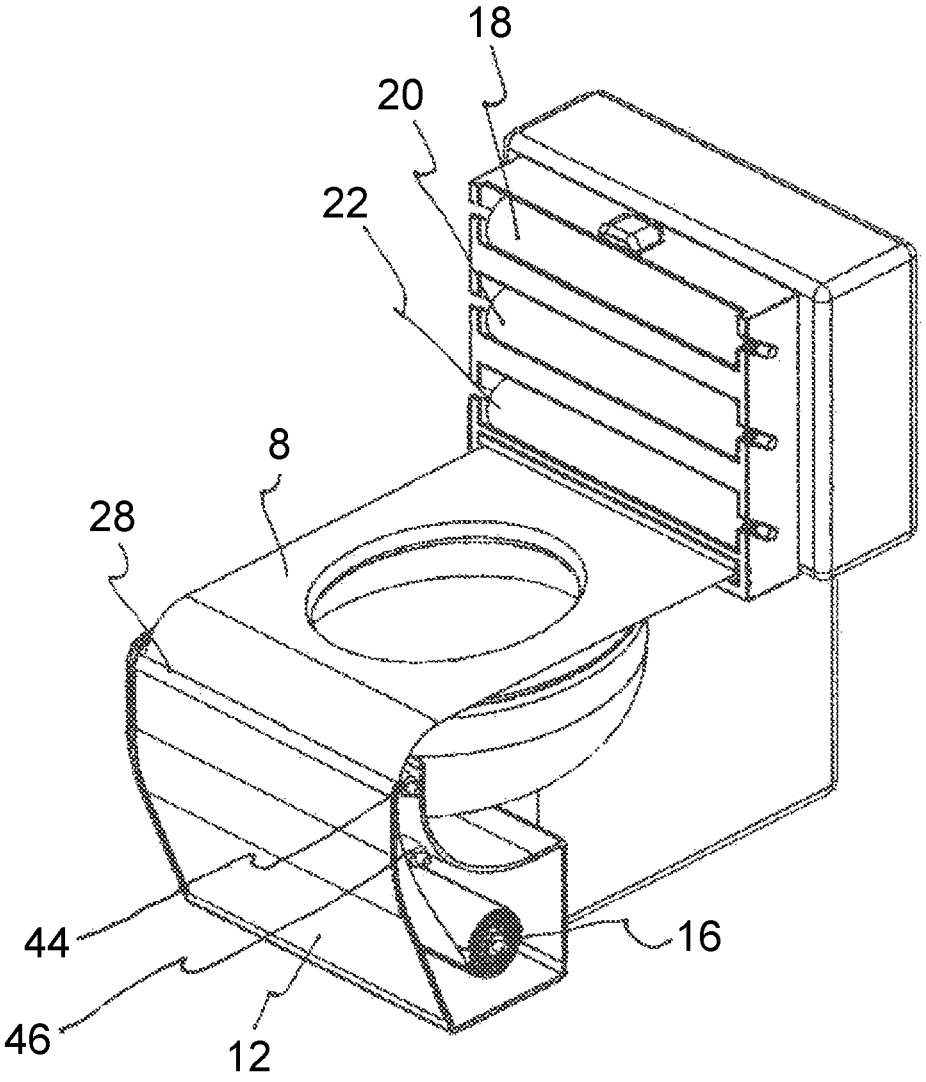
FIG. 4 is a perspective view of the embodiment with the side panel of the lower housing removed.

FIG. 4 is a perspective view of the invention 100 with the right-side panel of the take-up roll housing removed exposing take-up roll 16 as it rolls up sheet 8.

Figure 5:
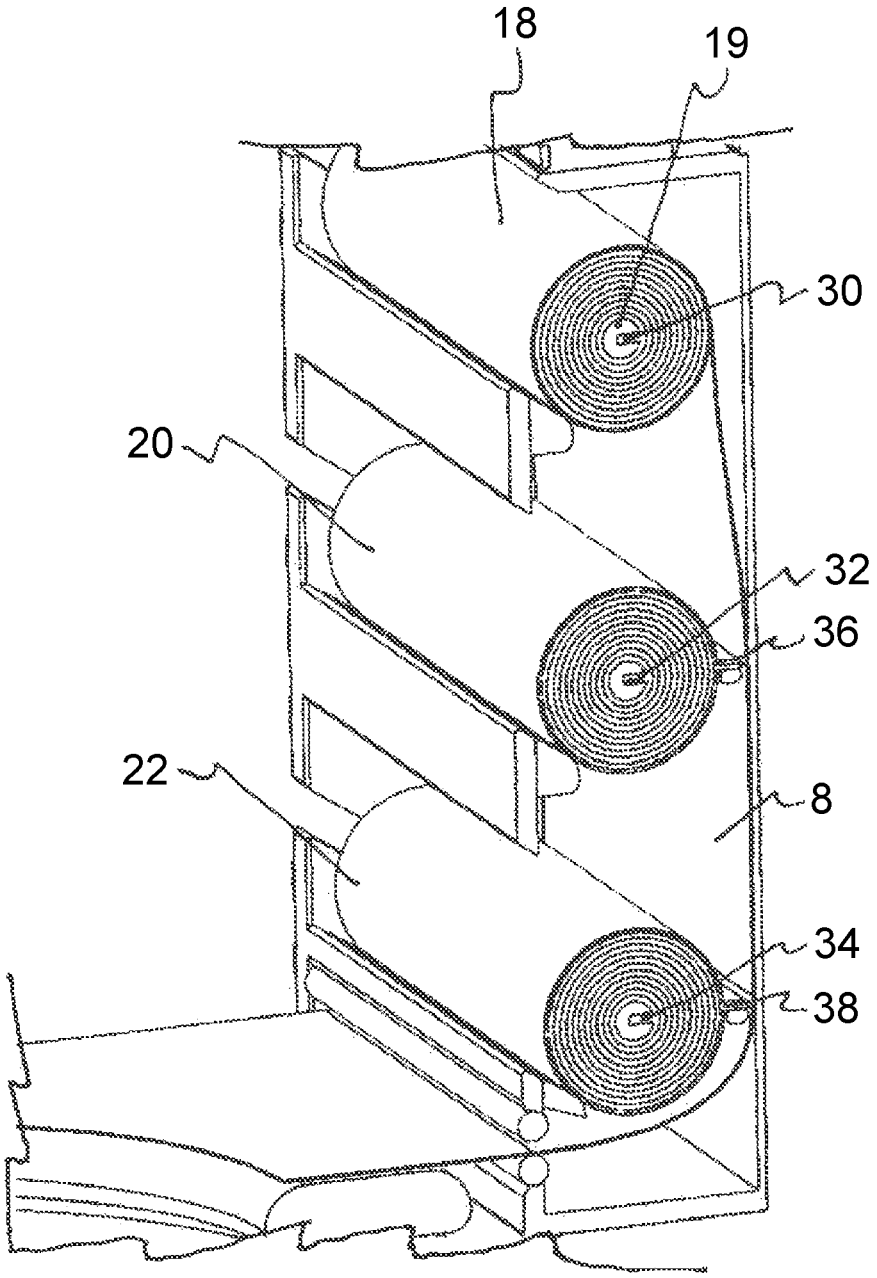
FIG. 5 is a partial perspective view of the embodiment showing the sheet of the top roll being drawn down over the toilet seat.

FIG. 5 is a partial perspective view showing sheet 8 being drawn from dispenser roll 18 as it is supported by spool 19. The sheet 8 passes through two rollers 62, 64 and then slides onto toilet seat 88.

Figure 6:
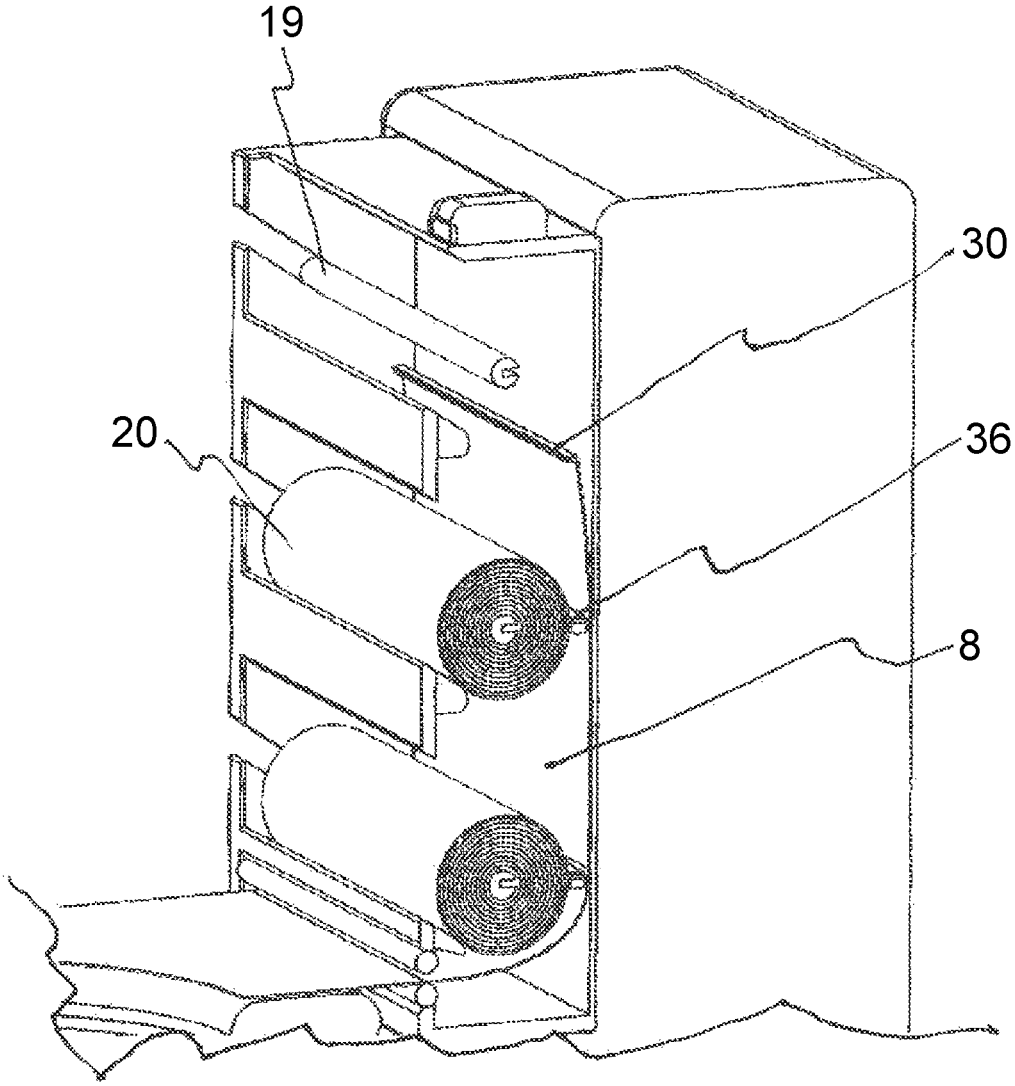
FIG. 6 is a partial perspective view of the dispenser roll assembly with the end of the top roll sliding down to meet the beginning of the second roll.

FIG. 6 is a partial perspective view showing the trailing edge 30 of sheet 8 leaving spool 19 and sliding down toward roll 20.

Figure 7:
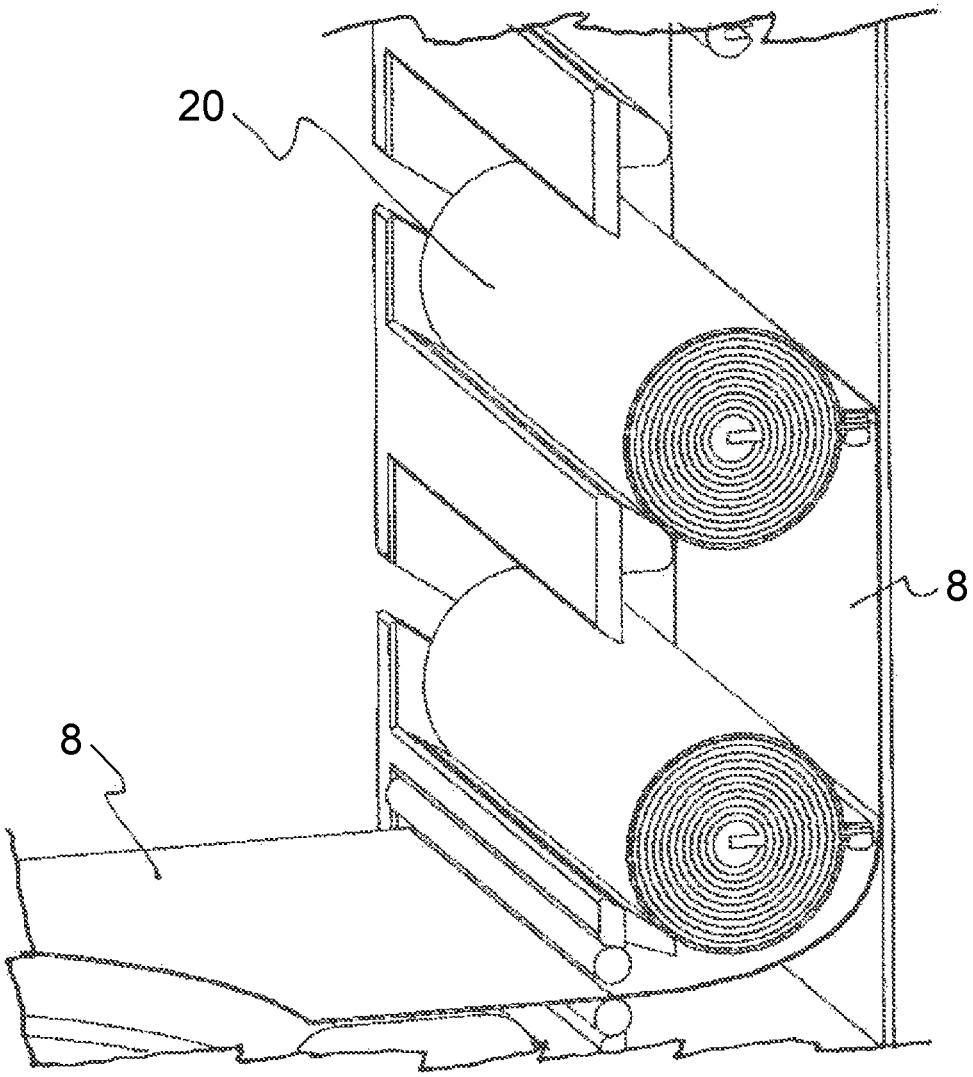
FIG. 7 is a partial perspective view of the end of the first dispenser roll making magnetic contact with the beginning of the second dispenser roll.

FIG. 7 is a partial perspective view showing the trailing edge of sheet 8 making contact with the leading edge of roll 20. The end of sheet 8 comprises a thin magnetic strip 30 and the beginning of roll 20 comprises a thin magnetic strip 36 so that when the two edges make contact they stick together. In this way, a plurality of rolls 18, 20, 22 can be sequentially joined together to form one long sheet that can be rolled up on take-up spool 16 thereby keeping the width of the dispenser housing 4 to a minimum. Other methods of connection may also be used, such as hook and loop attachment strips or edges comprising rigid U-shaped-inverted U-shaped pairs.

Figure 8:
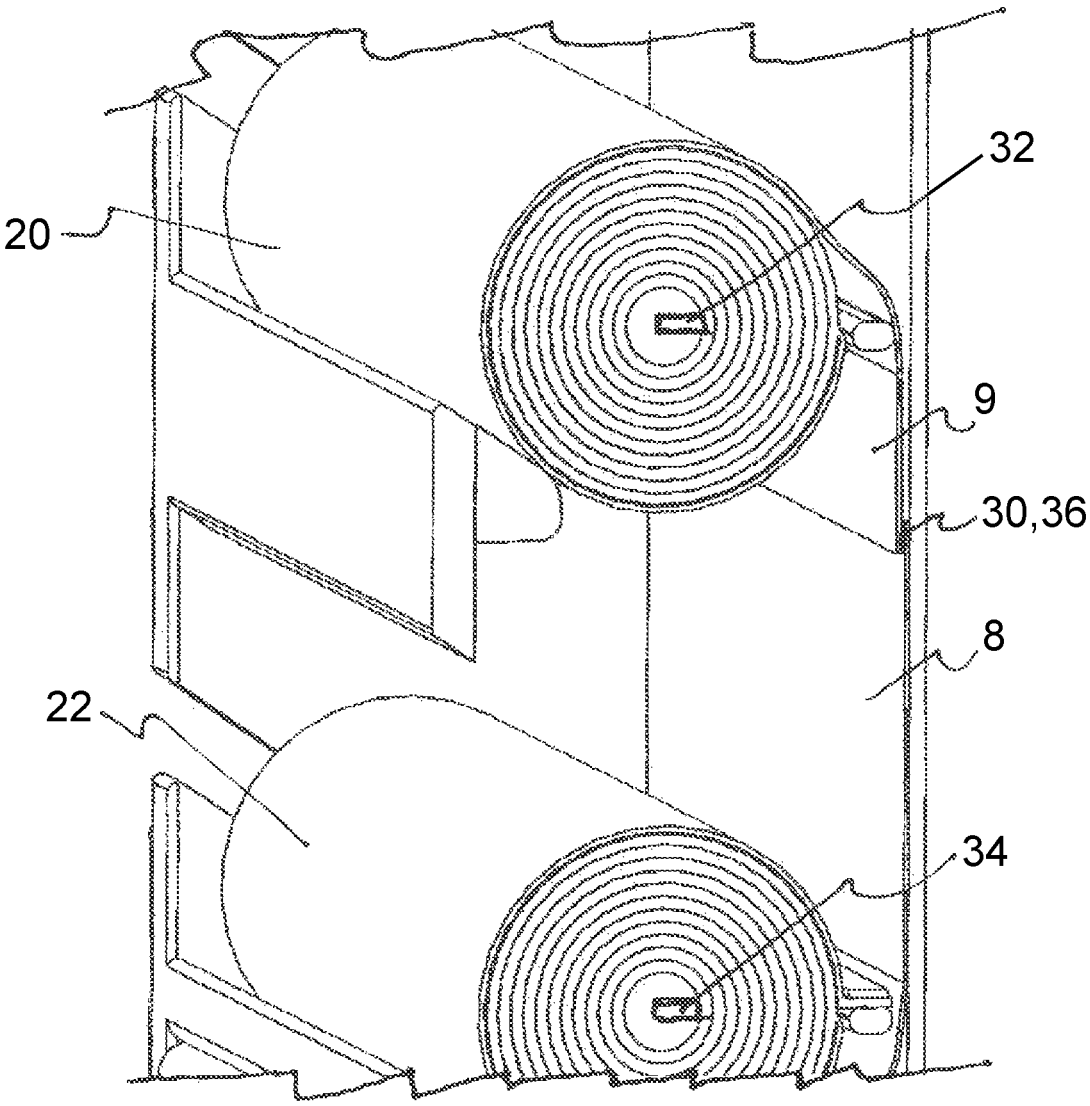
FIG. 8 is a partial perspective view of the beginning of the second roll being pulled by the end of the first roll.

FIG. 8 shows sheet 8 attached to sheet 9 via magnet strips 30, 36 thereby drawing sheet 9 down to be used on toilet seat 88. trailing strips 32 and 34 perform a similar task as each roll 20, 22 is used up.

Figure 9:
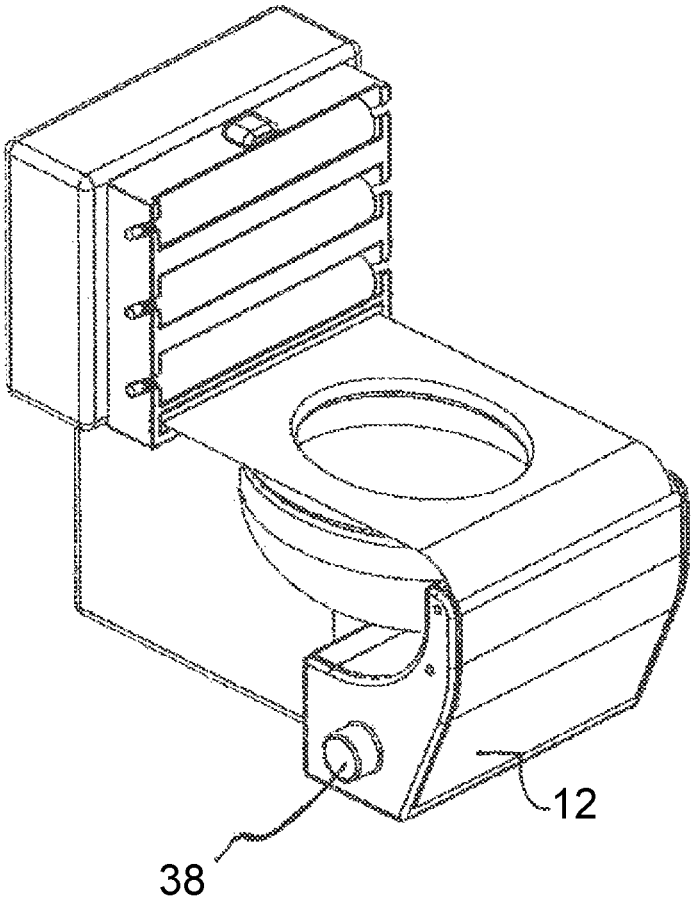
FIG. 9 is a perspective view of the left side of the embodiment.

FIG. 9 is a perspective view of the invention 100 seen from the left side. A cylindrical protrusion 38 to housing 12 accommodates and electric motor 40 and encoder 42 as shown in FIG. 10.

Figure 10:
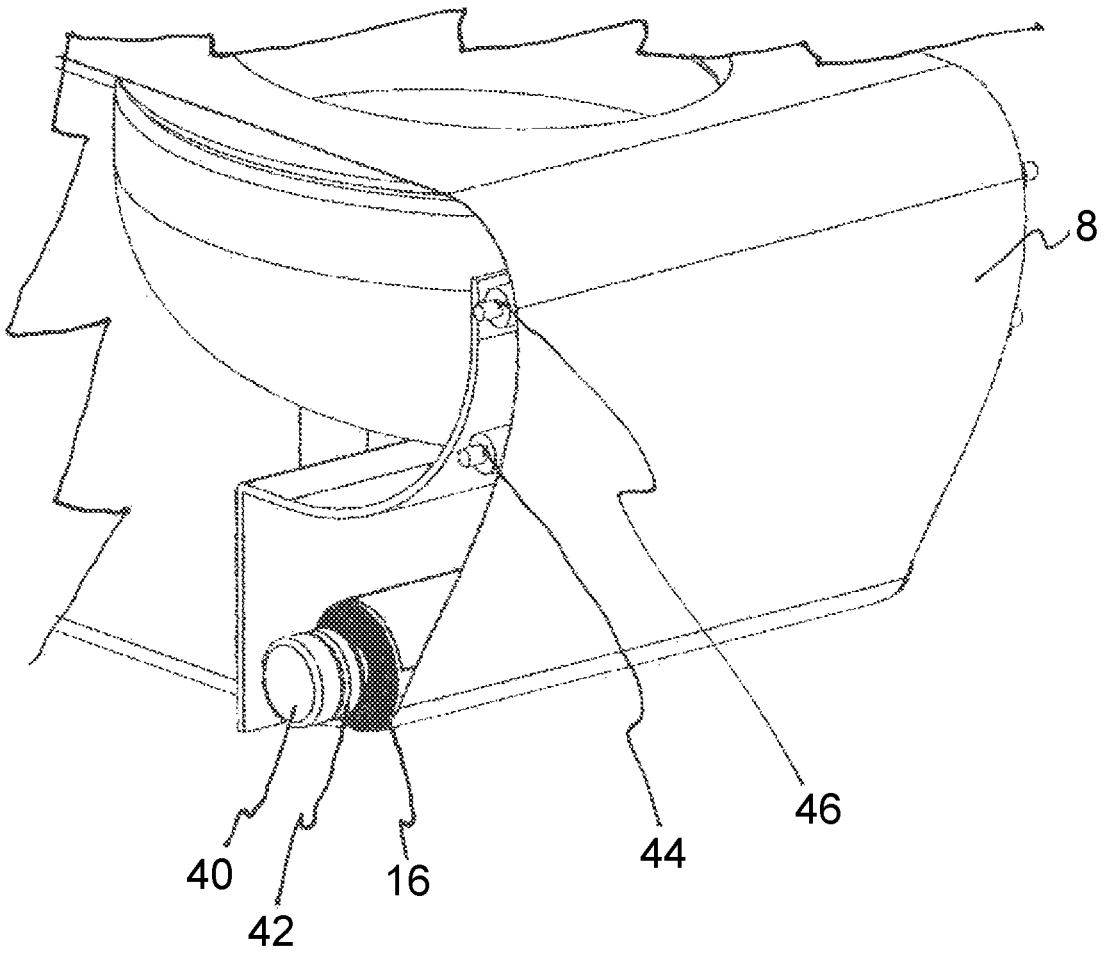
FIG. 10 is a partial perspective view of the take-up roll showing the motor and encoder.

FIG. 10 also clearly shows support rollers 44 and 46. Take-up roll 16 can be removed from housing 12 when all the dispensing rolls 18, 20, 22 are used up.

Figure 11:
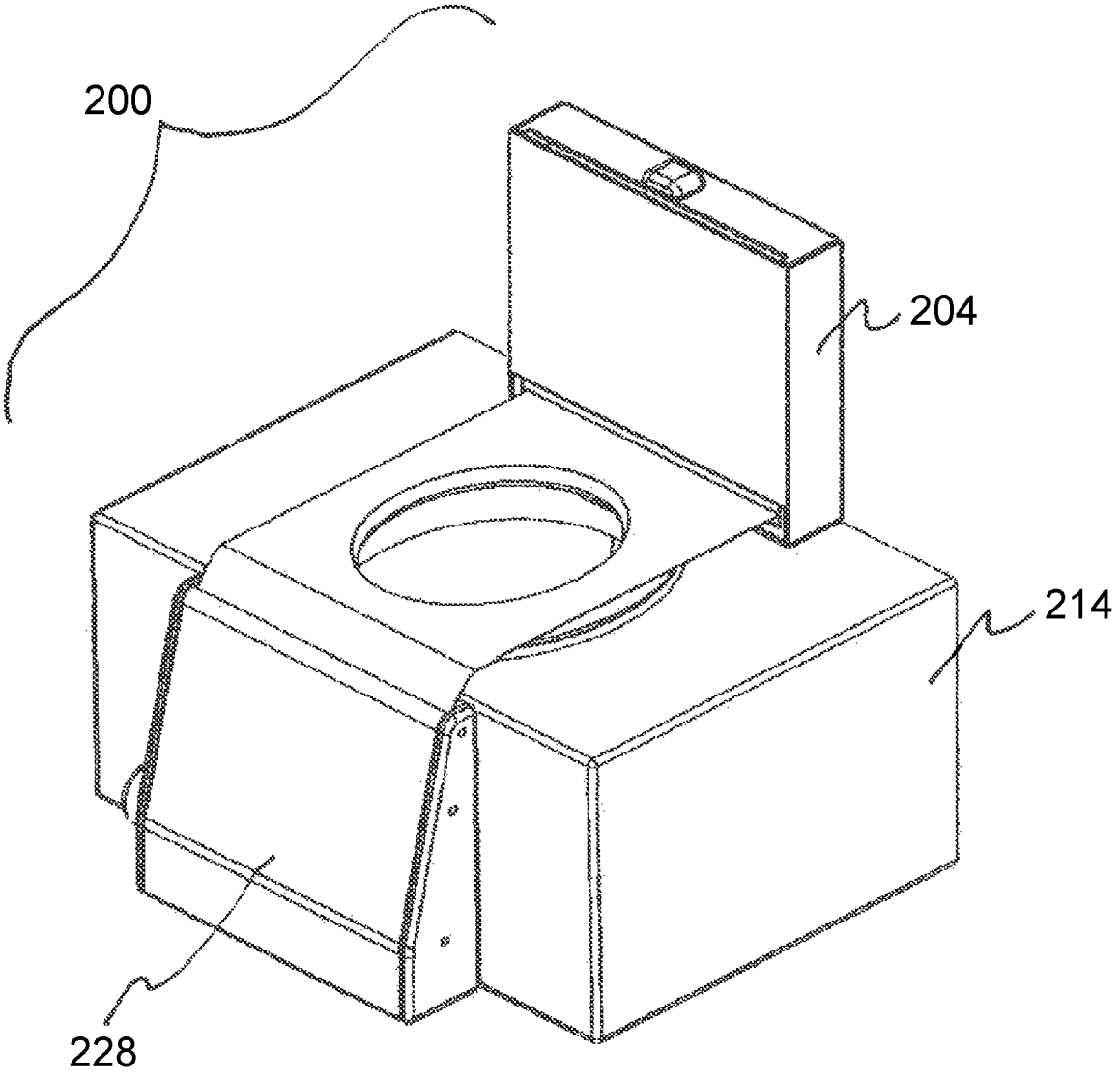
FIG. 11 is a perspective view of the embodiment used with a porta-potty.

FIG. 11 shows an alternate embodiment of the invention 200 that is designed to fit on a standard porta-potty unit 214 where the dispensing roll housing 204 would be mounted against the back wall of a porta-potty and the roll receiving housing 228 is mounted on the front wall of the porta-potty 214.

In the above described way, a toilet can have a continuously fresh seating surface for a user thereby reducing the possibility of disease due to touching a soiled toilet seat.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An automatic seat cover dispensing and removing apparatus for a use of covering a toilet seat with an aperture installed on a toilet bowl comprising:

a dispenser assembly and a take-up assembly, wherein the dispenser assembly further comprises a plurality of dispensing rolls, each dispensing roll comprising a dispensing spool and a thin sheet toilet seat cover material wound on the dispensing spool, wherein the cover material is comprised of evenly spaced apertures, length of material between adjoining apertures comprising the length of the toilet seat with additional material covering a distance between the toilet seat and the take-up assembly, each aperture of essentially same dimensions as the toilet seat aperture;

the take-up assembly comprising a take-up spool for rollingly collecting the sheet of the seat cover material after each use, wherein the take-up spool is rotated by an electric motor;

a control assembly comprising an electronic encoder circuit activating the electric motor to move the seat cover sheet material by a distance required for the aperture being rolled off the dispensing roll to be located above the toilet seat aperture, wherein the control assembly being located within the take-up assembly;

an occupancy sensor wired to the control assembly, wherein the sensor is located on the outside of the dispensing assembly positioned to sense a presence of a person and sending a signal to the electronic encoder circuit when the person is no longer in range of the toilet to command the motor to wind the dispensing roll sheet onto the take-up spool until a new aperture in the seat cover material sheet is positioned directly over the toilet bowl seat; and the dispenser assembly being placed vertically behind the toilet bowl and the take-up assembly being placed in front of the toilet bowl and below the toilet seat;

each dispensing roll comprising a beginning and an end, the beginning and end of each dispensing roll sheet material comprising a magnetic strip fixedly attached across the width of the roll;

the dispensing rolls removably housed within an upper dispenser roll housing, wherein the end of a dispensing roll engages the beginning of a full roll to smoothly continue the winding of the seat cover sheet material onto the take-up roll;

the take-up roll assembly housed within the take-up roll housing; and the dispensing roll sheet directed down from the dispensing housing and over the toilet bowl seat and then down through a slit in the take-up roll housing and onto the take-up roll spool.

2. A seat cover apparatus of claim 1 further comprising guide rollers within the take-up roll housing to guide the dispenser sheet smoothly onto the take-up roll spool.

* * * * *